US007651238B2

(12) United States Patent
O'Brien

(10) Patent No.: US 7,651,238 B2
(45) Date of Patent: Jan. 26, 2010

(54) FIREPROOF TRIM AND INSULATED LIGHTING ASSEMBLY

(76) Inventor: Aaron O'Brien, 7801 Hohman Ave., Munster, IN (US) 46321

( * ) Notice: Subject to any disclaimer, the term of this patent is extended or adjusted under 35 U.S.C. 154(b) by 22 days.

(21) Appl. No.: 11/621,651

(22) Filed: Jan. 10, 2007

(65) Prior Publication Data

US 2008/0165545 A1 Jul. 10, 2008

(51) Int. Cl.
*F21V 15/06* (2006.01)

(52) U.S. Cl. ..... 362/148; 362/147; 362/150; 362/276; 362/294; 362/373

(58) Field of Classification Search ..... 174/480; 362/147–150, 276, 294, 364, 365, 404, 373
See application file for complete search history.

(56) References Cited

U.S. PATENT DOCUMENTS

| | | | | |
|---|---|---|---|---|
| 4,122,203 | A | 10/1978 | Stahl | |
| 4,237,671 | A * | 12/1980 | Munson | 52/28 |
| 4,754,377 | A * | 6/1988 | Wenman | 362/148 |
| 5,662,413 | A | 9/1997 | Akiyama | |
| 6,105,334 | A * | 8/2000 | Monson et al. | 52/741.3 |
| 6,357,891 | B1 * | 3/2002 | Newbold et al. | 362/147 |
| 6,726,979 | B2 | 4/2004 | Friedman et al. | |
| 6,838,618 | B2 * | 1/2005 | Newbold et al. | 174/50 |
| 7,114,294 | B2 | 10/2006 | Newbold et al. | |
| 7,208,677 | B2 * | 4/2007 | Moselle | 174/50 |
| 2004/0010990 | A1 | 1/2004 | Moselle | |
| 2006/0158873 | A1 | 7/2006 | Newbold et al. | |
| 2007/0268708 | A1 * | 11/2007 | O'Brien | 362/364 |

FOREIGN PATENT DOCUMENTS

| | | |
|---|---|---|
| EP | 1 754 935 A1 | 2/2007 |
| GB | 2 326 467 A | 12/1998 |

OTHER PUBLICATIONS

Capri Lighting; "FDIC6V90-FDSINC, 6" Fire Rated Recessed Incandescent Housing"; 2 pages; http://www.caprilighting.com/pdfspecs/FR1-5.pdf.

Department Of The Army, U.S. Army Corps of Engineers, Washington, DC, 20314-1000; "Engineering and Design—Composite Material For Civil Engineering Structures"; Technical Letter No. 1110-2-548; 66 pages; http://www.usace.army.mil/publications/eng-tech-ltrs/etl1110-2-548/entire.pdf.

* cited by examiner

*Primary Examiner*—Anabel M Ton

(57) ABSTRACT

A lighting assembly includes a light fixture adapted to be disposed in relation to an opening defined in a surface of a structure such that a lamp may be installed in the light fixture through the opening of the structure. A thermal insulation barrier surrounds the light fixture, is positioned in close proximity of the opening of the structure and constructed so as to entrap heat from the opening of the structure. A trim has an outer surface, configured to substantially enclose the opening, consists of at least one fireproof material, and is adapted to engage the light fixture so that the outer surface is disposed in proximity to the opening of the structure and forms a continuous surface with the structure.

19 Claims, 7 Drawing Sheets

FIREPROOF TRIM AND INSULATED LIGHTING ASSEMBLY

FIELD

The invention relates, generally, to a lighting assembly and, more particularly, to a fireproof trim and insulated recessed lighting assembly that, when installed in a ceiling, floor, or wall structure of a room, inhibits a fire in the room from traveling through the structure via the recessed lighting assembly.

BACKGROUND

Residential and commercial buildings must generally comply with certain fire safety standards such as set forth by Underwriters Laboratories (UL), National Fire Protection Association (NFPA), or other administrative agency. For example, wood joists and sheet rock are typically used to create a finished room in a residential or commercial building. When using such materials, the building room or structure must typically satisfy a specific UL "fire-rated" assembly standard. For example, one applicable test is UL's 1 hr. Fire Rated L-500 Floor-Ceiling Assembly test. This test measures and rates a given floor-ceiling recessed assembly for fire safety compliance, as related to flame containment and thermal transfer to adjacent joist spaces. Additional safety standards, such as UL 1598, apply to recessed lighting assemblies or fixtures and electrical enclosures for use in residential and commercial applications.

In current residential and commercial buildings, recessed lighting assemblies or fixtures are typically installed in a space between the ceiling joists, rafters or I-beams (e.g., "ceiling support members") and above an existing ceiling substrate, i.e., drywall, plaster, wood, planking, etc. After making the proper electrical connections, drywall is usually attached to the ceiling support members concealing the recessed lighting assembly. The installer then cuts a hole into a surface of the drywall of the ceiling to access the recessed lighting assembly below the ceiling surface for fixture lamping, and finished trim installation. As a result, the recessed lighting assembly is positioned in relation to the ceiling surface to distribute light into the room.

However, one problem associated with installing a conventional recessed lighting assembly in such a manner is that the hole cut in the surface can change the UL fire safety ratings of the conventional recessed lighting assembly as a result of the ceiling structure being breached. For example, by cutting a hole into the ceiling, a non-continuous surface results and the conventional recessed lighting assembly may no longer satisfy certain UL fire safety standards. Flame, heat or both may enter the space above the conventional recessed lighting assembly via the non-continuous surface with the ceiling causing severe damage or total loss of the structure.

To inhibit this problem from incurring, a builder or installer may fabricate a conventional "fire box" around the conventional recessed lighting assembly just prior to installation to create a continuous ceiling surface. The "fire box" is typically made from the same drywall used to form an adjacent ceiling. Most building inspectors interpret such a continuous ceiling surface as complying with all applicable fire standards as long as the appropriate materials are used. However, because the fire box is unattached and must be fabricated by the installer separately from the lighting assembly, a substantial amount of additional time, materials and expense can be incurred. Moreover, because most builders are unsure of the minimum size box to provide sufficient fire safety, exceedingly large boxes are typically utilized, causing unnecessary cost and expense. Further, during typical operating conditions of a conventional recessed lighting assembly, the temperature of the materials used to fabricate the fire box needs to remain at or below 125 degrees Fahrenheit in order to maintain the fire resistant properties of the materials. However, these operating conditions of a conventional recessed lighting assembly have been proven to be economically prohibitive to monitor and control.

Therefore, a need exists for a recessed lighting assembly that overcomes the problems noted above and others previously experienced for inhibiting heat in a room from traveling through a ceiling, floor, or wall of the room via the recessed lighting assembly. These and other needs will become apparent to those of skill in the art after reading the present specification.

SUMMARY

The foregoing problems are solved and a technical advance is achieved by the present invention. Articles of manufacture and systems consistent with the present invention provide a recessed lighting assembly that inhibits the transfer of heat, for example from a fire, from traveling through ceiling via the lighting assembly to an area above the ceiling surface.

A lighting assembly includes a light fixture, a thermal insulation barrier, and a trim. The light fixture is adapted to be disposed in relation to an opening defined in a surface of a structure such that a lamp may be installed in the light fixture through the opening. The thermal insulation barrier surrounds the light fixture, is positioned in close proximity of the opening and constructed so as to entrap heat from the opening. The trim is configured to substantially enclose the opening and consists of at least one fireproof material. The trim is adapted to engage the light fixture and has an outer surface disposed in proximity to the opening in the structure to form a continuous surface with the structure.

Articles of manufacture consistent with the present invention also provide a thermal insulation barrier integral to a lighting fixture of a lighting assembly. The thermal insulation barrier comprises an insulating material, which is suitable for continuous use at temperatures at or below 1080 degrees F., and has a predetermined R-value which is greater than a value of 2.2 per inch of thickness. The thermal insulation barrier is constructed in a manner to inhibit heat from transferring via the opening of the light fixture through the lighting assembly to an area above the surface of the structure.

Articles of manufacture consistent with the present invention also provide a trim for mating to a lighting fixture. The trim comprises an outer surface and is adapted to engage the light fixture so that the outer surface of the trim is disposed in proximity to the opening in the structure. The trim further includes a gasket disposed about at least a portion of the outer surface of the trim.

Other systems, apparatus, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE DRAWINGS

Reference will now be made in detail to an implementation consistent with the present invention as illustrated in the accompanying drawings. Wherever possible, the same reference numbers will be used throughout the drawings and the following description to refer to the same or like parts. As would be understood to one of ordinary skill in the art, certain components or elements for installation of a recessed light fixture (e.g., building support members, hanger arms, junction box, or electrical connections) are not shown in the figures or specifically noted herein to avoid obscuring the invention.

Figure 1:
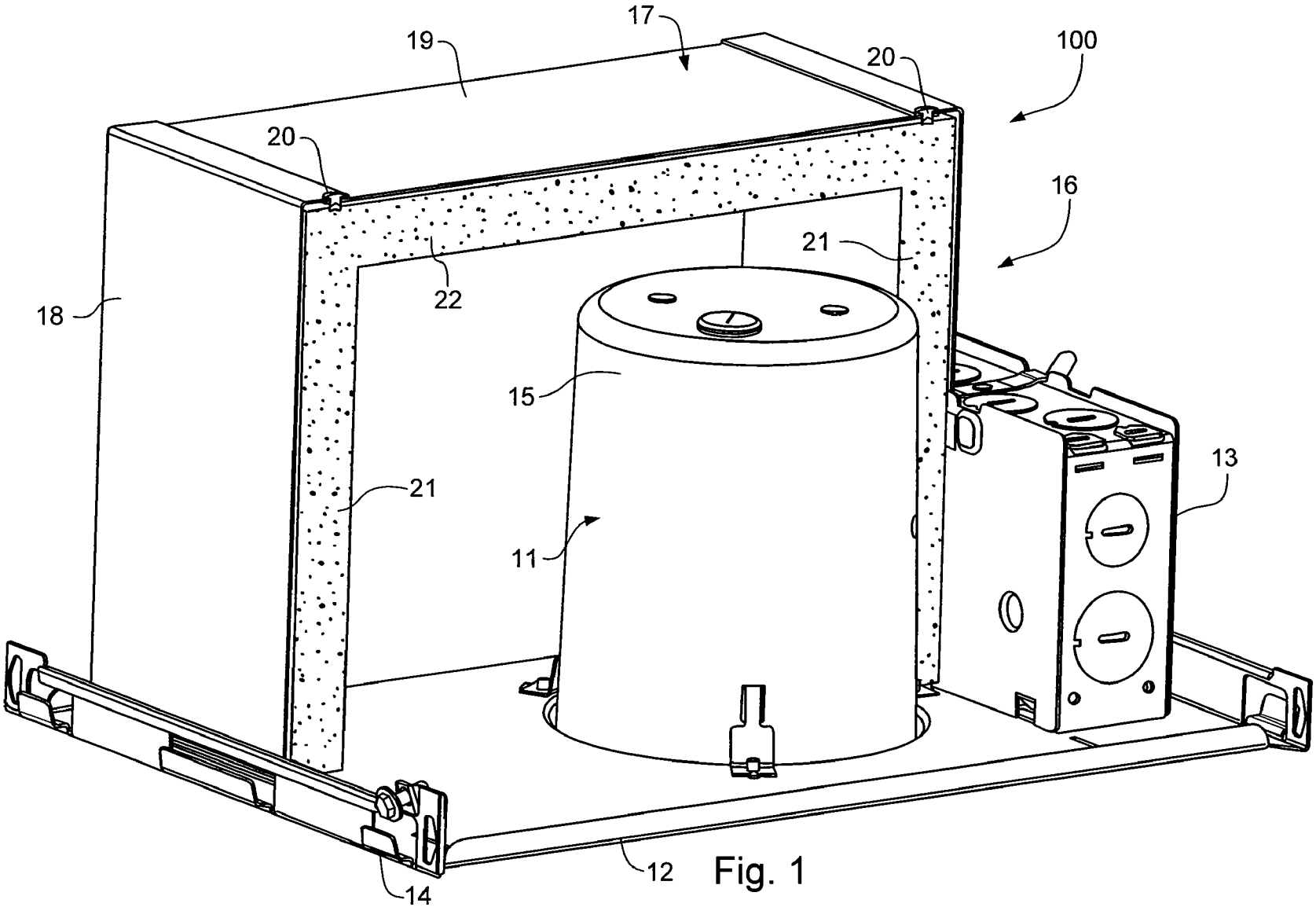
FIG. 1 is a perspective view of one embodiment of a lighting assembly having a light fixture, and a housing providing a thermal insulation barrier consistent with the present invention.

FIG. 1 depicts one embodiment of a lighting assembly 100 consistent with the present invention. The lighting assembly 100 comprises a light fixture 11 mounted on a pan 12. A wire junction box 13 is mounted on the pan 12 and is connected to a lamp socket (socket 26 as in FIG. 2), which is typically mounted internally to the light fixture 11, by a wire conduit (not shown). The pan 12 typically includes hanger bar brackets 14 that slidably engage adjustable bar hangers or rails (not shown) used to mount or affix the pan 12 on a pair of ceiling joists or beams (not shown).

In FIG. 1, the light fixture 11 includes a can or lamp housing 15 having a cylindrical shape. However, the can 15 may have another shape, such as box-like, frusto-conical, hour glass, and the like. The can 15 may be formed of a material having high heat or fire resistance properties, such as metal, ceramic, polymer, or any combination thereof. The can 15 is preferably formed of aluminum or steel. This can 15 is detachably affixed to the pan 12 and adapted for operations in accordance with safety and electric code requirements, such as UL standards and the like, when operating with proper lamping. To the extent necessary, the building and lighting industry standard UL 1598, as well as other appropriate safety standards, are incorporated by reference herein. The pan 12 may be formed of steel or any other material that prevents or reduces the spread of flame.

As shown, the light assembly 100 includes a fire box or fixture housing 16. The housing 16 is constructed in a manner so as to surround or enclose the can 15 (and thus, the light fixture 11) while being detachably supported on the pan 12. The housing 16 includes a support shell or structure 17 which may be formed of one integral element or a plurality of elements assembled and fastened together to form four side walls 18 and a top wall 19. As shown, the plurality of elements forming the walls 18 and 19 may be attached or affixed to one another via clamps 20 or the like, and may be formed of a high heat resistant material, such as metal, ceramic, polymer, or any combination thereof. The walls 18 and 19 and clamps 20 are preferably formed of aluminum or steel. Alternately, the support structure 17 may be integrally formed to define the side walls 18 and the top wall 19 without the clamps 20.

As shown, the housing 16 includes four inner side walls 21 and a top inner wall 22 which can be attached to the inner surfaces of walls 18 and 19 via screws, glue or other fasteners (not shown). Once attached to the walls 18 and 19, the inner walls 21 and 22 may be integrally connected with the housing 16 and positioned so as to extend from the panel 12 to form a continuous surface therewith. The inner walls 21 and 22 may be made from an insulating material that is not necessarily fire resistant but suitable for continuous use at operating temperatures at or below 1080 degrees Fahrenheit. The thermal insulating material may be a material or combination of materials which retard or resist the flow of heat in order to prevent or reduce damage to equipment from exposure to fire or corrosive atmospheres. The thermal insulating material may have a thermal resistance "R" or "R-value" factor greater than 2.2 per inch of thickness. The R-value denotes a measure of an overall resistance of building materials and structures to the flow of heat. By definition, the higher the R-value the better the material is as a thermal insulator. Thus, the housing 16, which includes the sidewalls 18 and top wall 19 as well as the inner walls 21 and 22, is constructed so as to form a thermal resistance or barrier that entraps heat within a volume or space delimited by the inner walls 21 and 22 and the pan 12. Alternately, the inner walls 21 and 22 need not comprise the same insulating material.

Although the housing 16 is shown as having a box shape (e.g. cube or rectangle), the housing 16 may have any other shape or dimension, and contain any number of walls, so long as the housing 16 extends from the pan 12 to form a substantially continuous surface therewith. Alternately, the housing 16 may have a cylindrical shape.

Figure 2:
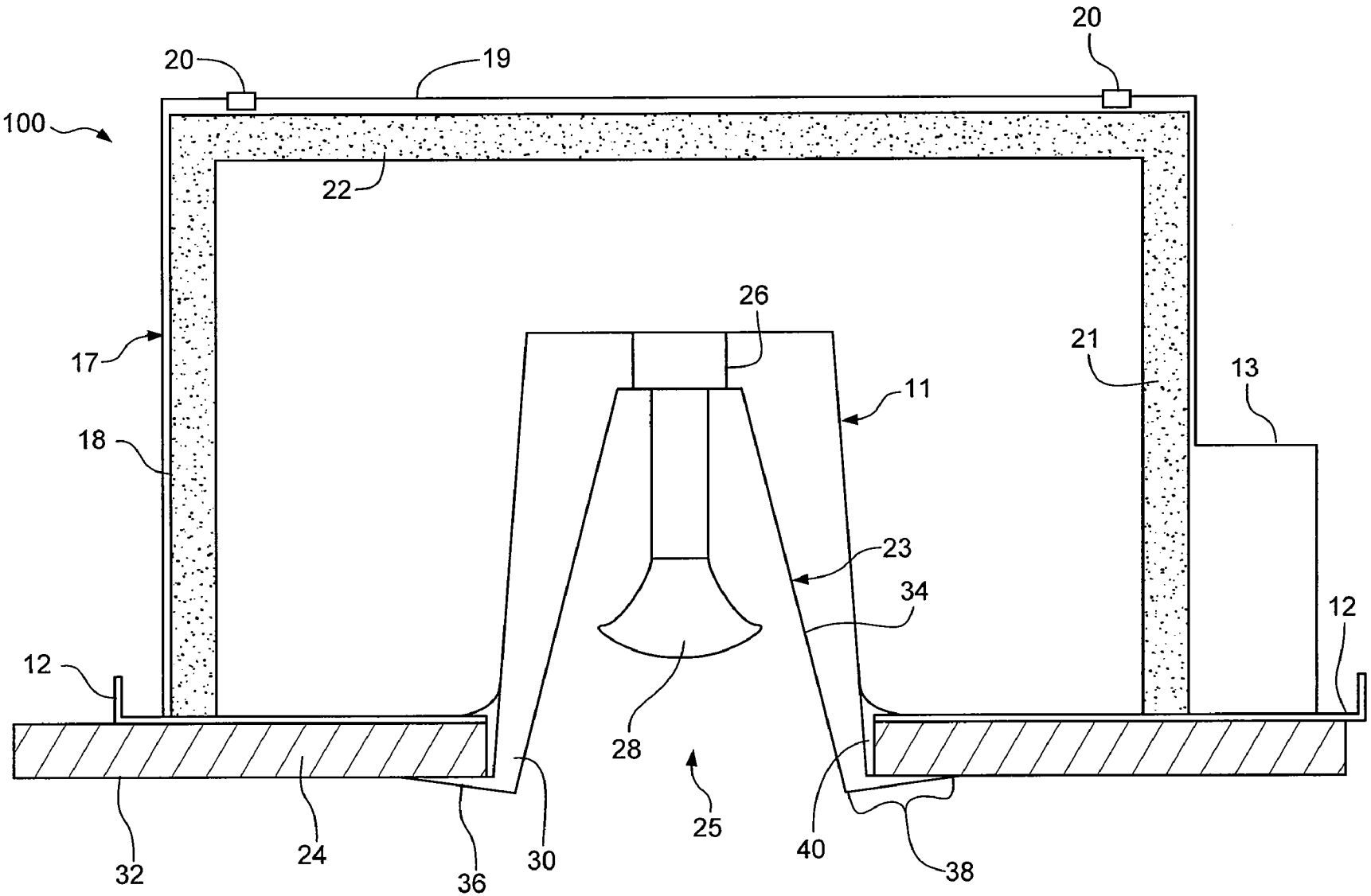
FIG. 2 is a cross-sectional side view of the lighting assembly of FIG. 1 having a trim consistent with the present invention.

Now referring to FIG. 2, a cross-sectional side view of the lighting assembly 100 is illustrated. As shown, the lighting assembly 100 includes a trim 23 adapted to mate with or be installed on the light fixture 11. The trim 23 may have a cylindrical shape, a conical shape, or another shape adapted to allow light out of the light fixture 11. The trim 23 may include or be made from a fireproof material. The lighting assembly 100 is shown positioned after installation above a structure 24. The structure 24 may be a ceiling, a floor, or a wall of a room that is attached to joists, rafters, I-beams, studs, headers, or other building support members. The light fixture 11 is positioned concentrically with an opening 25 defined in the pan 12 and includes a lamp socket 26 positioned relative to the opening 25. The trim 23 is adapted to be introduced through the opening 25 and removably engaged to the socket 26 of the light fixture 11 such that such that a lamp 28 may be installed in the socket 26 of the light fixture 11 through the opening 25. Typically, the socket 26 is positioned concentrically with the opening 25, but may be positioned at any other location within the light fixture 11 to at least partially illuminate the space below the opening 25 of the light fixture 11.

As shown in FIG. 2, the trim 23 is disposed in relation to an opening 30 defined in a surface 32 of the structure 24. A builder or installer may cut the opening 30 in the structure 24 after attaching the light fixture 11 to the building support members located on the same side of structure 24 as the light fixture 11. Alternatively, the builder or installer may pre-cut the opening 30 in a portion of the structure 24 (e.g., a sheet of drywall for forming a ceiling) before installing the portion of the structure 24 such that the opening 30 in the structure 24 is aligned with the opening 25 in the pan 12.

The trim 23 has an outer surface 34, which is disposed in proximity to the opening 30 in the structure 24 after installation of the light assembly 100. Moreover, the outer surface 34 is configured to substantially enclose the opening 30. The trim 23, which is depicted with a cone shape, includes an integral trim ring or flange 36. The flange 36 is adapted to extend over a portion 38 of the structure surface 32 extending from the opening 30. Moreover, the flange 36 is shaped and sized so as to cover a potential gap 40 between the light fixture 11 and the structure 24 and to provide a continuous surface with the structure surface 32.

This trim 23 may be made from a fireproof material or combination of fireproof materials that substantially reduces heat from the lamp 28 installed in the light socket 26 or from a source below the structure 24 from reaching an area above the structure 24 and external to the light assembly 100. Preferably, the trim 23 may be made of at least one fireproof material. Fireproof materials are known in the art to be able to resist combustion for a specified time under conditions of standard heat intensity without burning or failing structurally.

In one implementation of the light assembly 100, the trim 23 may include a gasket (not shown) adapted to cover a portion of the flange 36 so as to provide a seal between the flange 36 and the structure 24 while maintaining the continuous surface between them. The lighting assembly 100 may be used in installations where the housing 16 is in contact with insulation or not in contact with insulation. In addition, the trim 23 may include a lens, baffle, and/or diffuser not shown in the figures.

In another implementation of the light assembly 100, the trim 23 may include a thermal insulation (not shown) that may be disposed between the light fixture 11 and the trim 23 so as to inhibit heat from transferring via the trim 11 through the lighting assembly 100 to an area above the structure 24.

Figure 3:
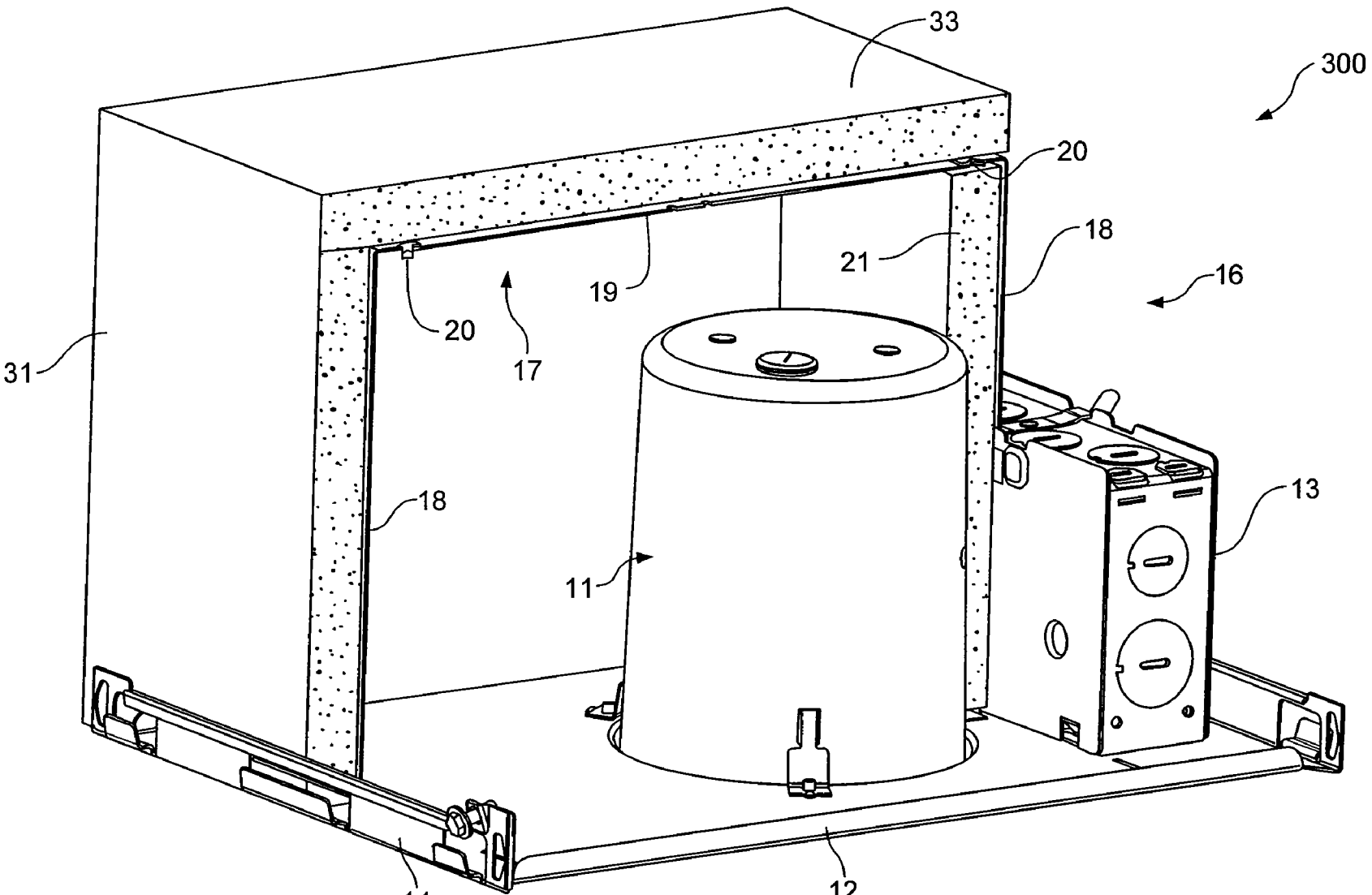
FIG. 3 is a perspective view of another embodiment of the lighting assembly of FIG. 1 consistent with the present invention.

Now referring to FIG. 3, another embodiment of a lighting assembly 300 is shown. Consistent with the lighting assembly 100 discussed above in regard to FIG. 1, the lighting assembly 300 has a housing 16 that includes walls 18 and 19. In this implementation, the housing 16 may include an inner side wall 21 and side 31 and top 33 outer walls, which may be attached to outer surfaces of the walls 18 ands 19. The inner side walls 21 and the outer walls 31 and 33 collectively form the thermal insulating barrier of the housing 16.

Alternately, the support shell or structure 17 of the housing 16 may be a cage or frame (not shown) formed by a plurality of edges assembled and fastened together and detachably formed on the pan 12. In this implementation, inner walls 21 and 22 and/or outer walls 31 and 33 may be attached to the plurality of edges of the cage to enclose the light fixture 11 and form a continuous surface with the pan 12 to provide the thermal insulating barrier of the housing 16.

In accordance with above discussed embodiments, the housing 16 may be detachably connected to the pan 12 via the walls 18 and 19, the inner walls 21 and 22 and outer walls 31 and 33, or the edges of the cage-like structure 17. As such, the light assembly 100 or 300 can be sold and installed as a single, integral unit, or can also be sold and installed as separate units. When sold separately, the installer needs to insure that the housing 16 and the pan 12 are properly and suitably connected during installation so as to form the thermal insulating barrier as configured by the manufacturer of the light assembly 100.

When utilized with the cage-like structure 17, the inner walls 21 and 22 and outer walls 31 and 33 can also be attached to other walls (not shown) to form a multilayer housing 16. The other walls may be made of materials, such as aluminum or steel, to help ensure that the needed R-value of the thermal insulating barrier of the housing 16 is attained or exceeded. When multiple layers are utilized to form one or more walls of the housing 16, any suitable method of attachment known in the art may be used for attaching the wall layers. For example, in one embodiment, an adhesive can be used to attach the wall layers. Moreover, in another embodiment, the wall layers can be attached mechanically through screws or other types of fasteners.

Figure 4:
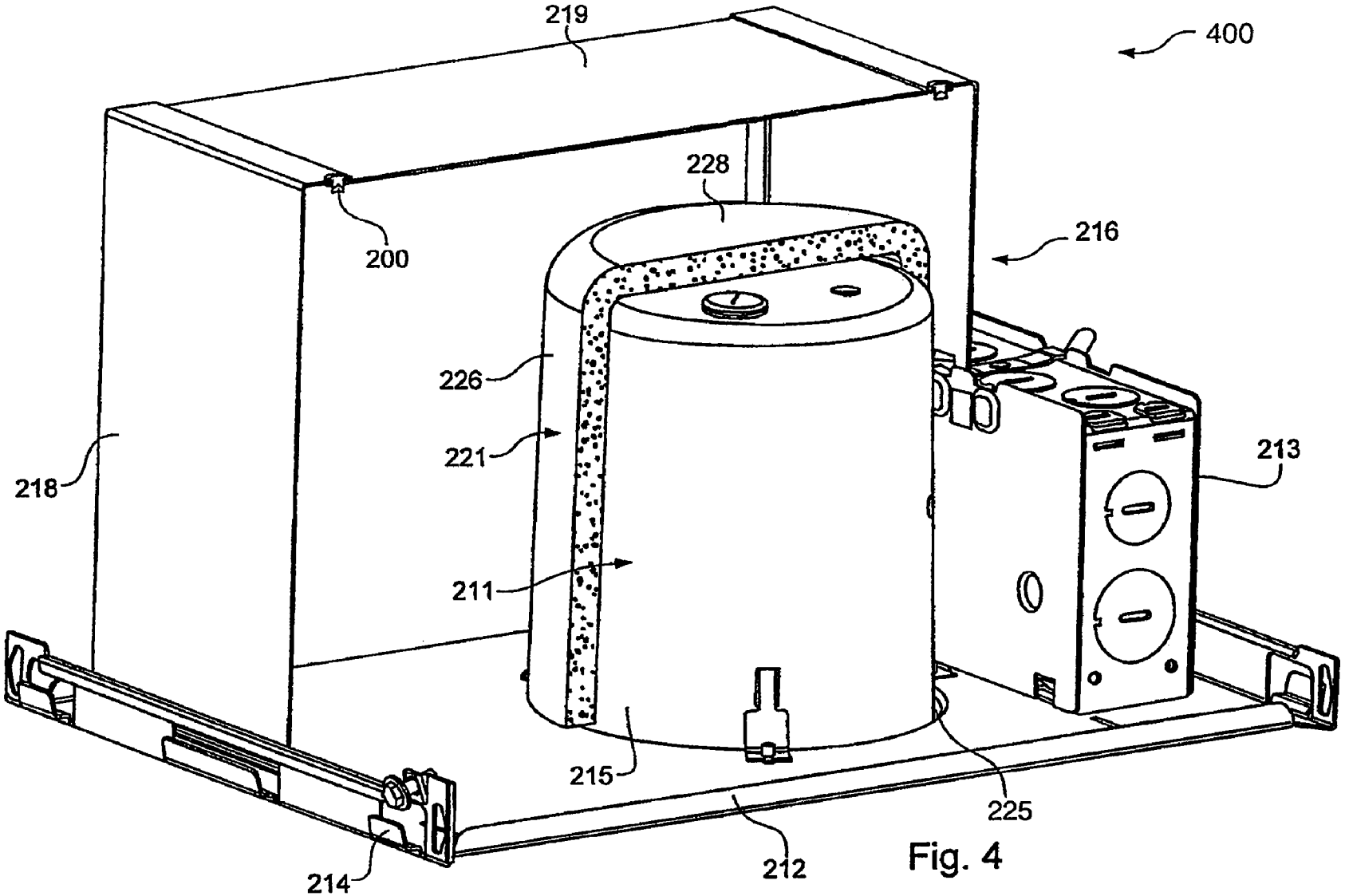
FIG. 4 is a perspective view of another embodiment of a lighting assembly having a thermal insulation barrier enclosing the light fixture consistent with the present invention.

Now referring to FIG. 4, an embodiment of a lighting assembly 400 is shown. The light assembly 400 comprises a light fixture 211 mounted on a pan 212. The light fixture 211 includes a can or lamp housing 215 having a cylindrical shape. The can 215 may be formed of a material having high heat or fire resistance properties, such as metal, ceramic, polymer, or any combination thereof. The can 215 is preferably formed of aluminum or steel. This can 215 is detachably affixed to the pan 212 and adapted for operations in accordance with safety and electric code requirements, such as UL standards and the like, when operating with proper lamping. The light assembly 400 includes a fire box or housing 216. The housing 216 is constructed in a manner so as to surround or enclose the can 215 while being detachably supported on the pan 212. The housing 216 may be formed of one integral element or a plurality of elements assembled and fastened together to form four side walls 218 and a top wall 219. As shown, the plurality of elements forming the walls 218 and 219 may be attached or affixed to one another via clamps 220 or the like, and may be formed of fire resistant materials, such as metal, ceramic, polymer, or any combination thereof. The walls 218 and 219 and clamps 220 are preferably formed of aluminum or steel.

In this embodiment, the light assembly 400 includes a cover or jacket or shell 221 that encloses the light fixture 211. The shell 221 is positioned to surround or enclose the can 215 and encompass an opening 225 defined in the pan 212 while being detachably supported on the pan 212. As shown, the shell 221 has a cylindrical shape, with a wall 226 and a top end 228. The cover 221 may have any other shape or dimension, and contain any number of walls, so long as the cover 221 extends from the pan 212 to form a continuous surface therewith. Alternately, the cover 221 may have a box shape.

In order to provide a suitable thermal insulating barrier, the cover 221 may be made from an insulating material suitable for continuous use at operating temperatures at or below about 1080 degrees Fahrenheit. As discussed above, the thermal insulating material may have a thermal resistance "R-value" factor greater than 2.2 per inch of thickness. To secure the position of the cover 221 relative to the opening 225, the cover 221 may be affixed to the can 215 so as to be integrally connected with the light fixture 211. Alternately, the cover 221 may be attached to the pan 212 via screws or other fasteners (not shown).

Figure 5:
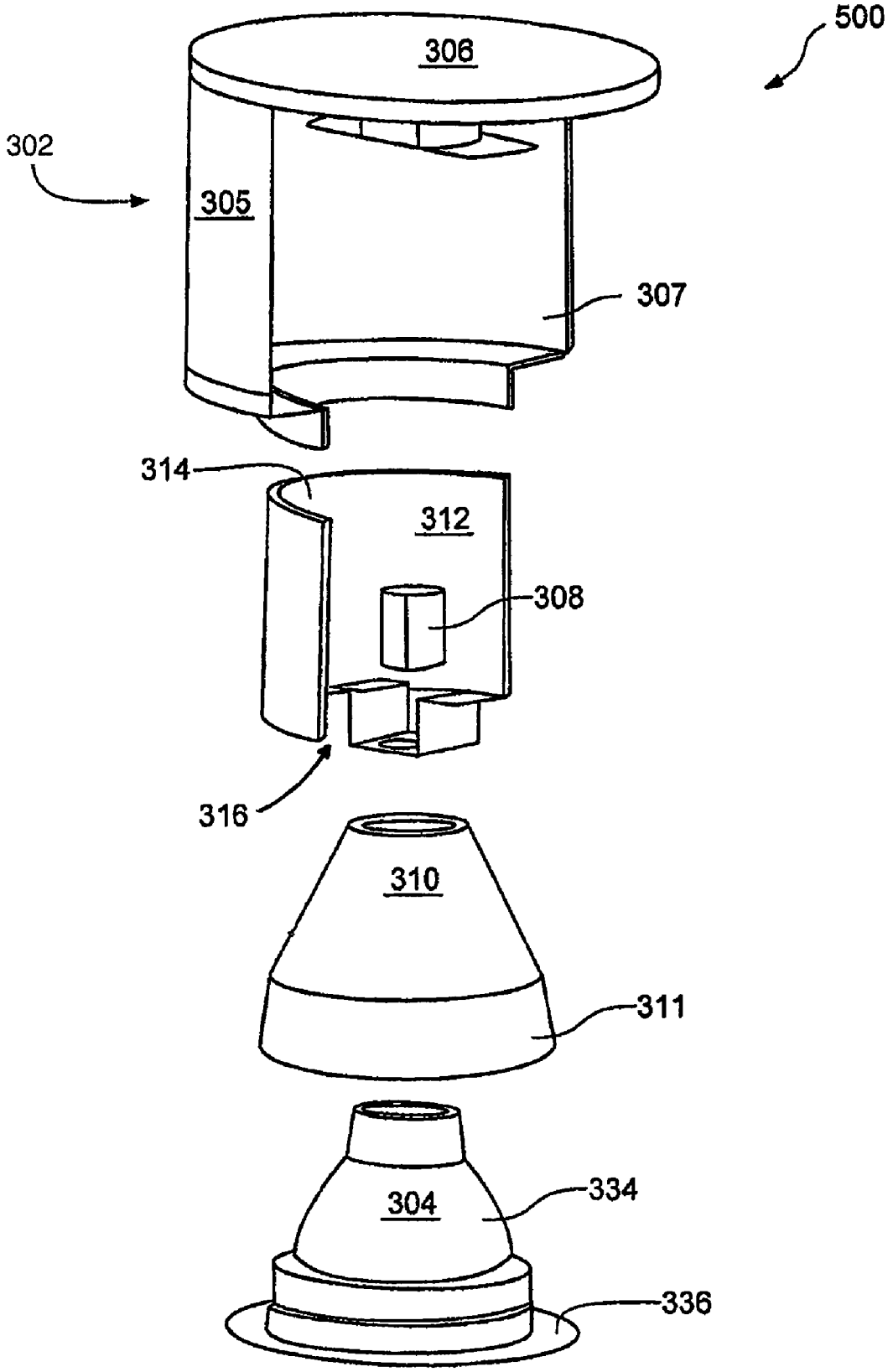
FIG. 5 is an exploded view of another embodiment of a lighting assembly having a light fixture, a trim, a thermal insulation barrier consistent with the present invention.

FIG. 5 depicts an exploded view of another embodiment of a lighting assembly 500 consistent with the present invention. The lighting assembly 500 includes a light fixture 302 and a trim 304 adapted to mate with or be installed on the light fixture 302. The trim 304 may have a cylindrical shape, a conical shape, or another shape adapted to allow light out of the light fixture. The trim 304 may include or be made from a fireproof material.

The lighting fixture 302 includes a fire box or housing 305, which may be made from steel or other fire resistant material.

The housing 305 has a closed top end 306 and an open bottom end 307 and a lamp socket 308 adapted to be positioned relative to the open end 307 such that such that a lamp (not shown in the figures) may be installed in the socket 308 of the light fixture 302 through the open end 307. The lighting assembly 300 includes an internal can or housing 310 adapted to be disposed within the housing 305 and made from reflective or fire resistant material. The can 310 may have an open end 311 adapted to be disposed in proximity to and encompassed by the open end 307 of the housing 305.

The lighting assembly 500 includes an internal cylindrical structure or wall 312 adapted to be disposed within the housing 305 and made from heat resistant material. The cylindrical wall 312 may have an open top end 314 and an open bottom end 316 adapted to be disposed in proximity to the open end 307 of the housing 305. After installation of the light assembly 500 in a supporting structure (e.g. structure 24 in FIG. 2) which may be a ceiling, a floor, or a wall of a room, the cylindrical wall 312 is positioned within the housing 305 so as to be sandwiched between the closed top end 306 and the open bottom end 307 of the housing 305, forming a continuous surface connecting the wall 312, the top end 306 and the open bottom end 307. As such, the wall 312 and the housing 305 may collectively form a thermal insulating barrier that entraps heat within a volume or space located above the supporting structure and delimited by the cylindrical wall 312 and a top end 306 of the housing 305. Thus, the formed thermal insulating barrier reduces heat from a lamp (not shown) installed into the lamp socket 308 and/or from a source below the structure from reaching an area above the supporting structure and external to the light assembly 300.

The trim 304 is adapted to be introduced through the open end 307 and removably engaged to the socket 308. The trim 304 is typically disposed in relation to an opening (e.g. opening 30 in FIG. 2) defined in a surface 32 of the supporting structure 24. The trim 304 has an outer surface 334 which is disposed in proximity to the opening of the supporting structure 24 after installation of the light assembly 500 and configured to substantially enclose the opening. The trim 304, which is depicted with a cone shape, includes an integral trim ring or flange 336. The flange 336 is adapted to extend over a portion of the surface of the supporting structure. Moreover, the flange 336 is shaped and sized so as to cover a potential gap (e.g. gap 40 shown in FIG. 2) between the light fixture 302 and the supporting structure 24 and to provide a continuous surface with the surface 32 of the supporting structure 24.

As discussed above, the trim 304 may be made from a fireproof material or combination of fireproof materials that substantially reduces heat from the lamp installed in the light socket 308 and/or from a source below the supporting structure 24 from reaching an area above the trim 304.

Figure 6:
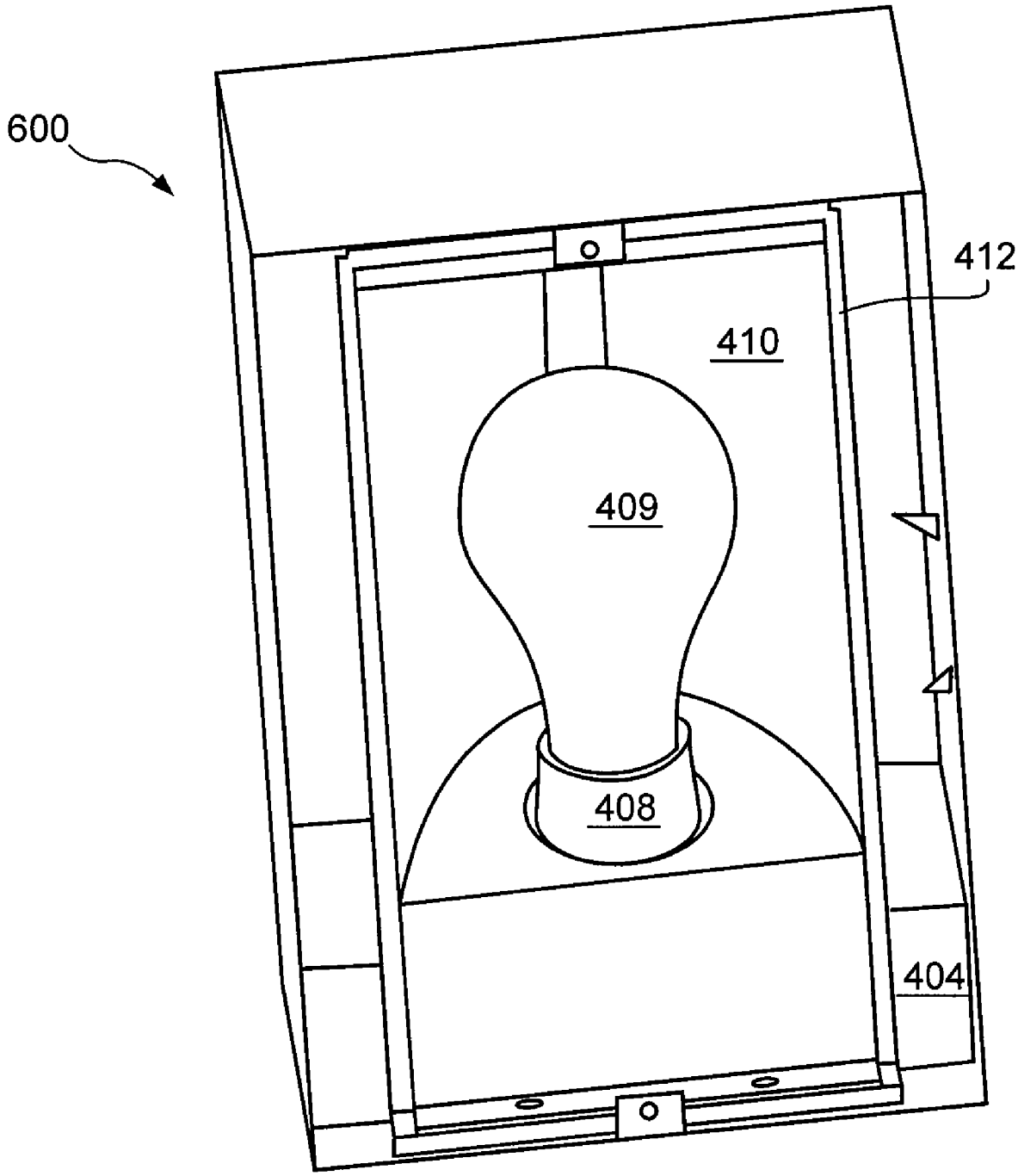
FIG. 6 is a perspective view of another embodiment of a lighting assembly having a light fixture, a thermal insulation barrier, and a trim consistent with the present invention.
Figure 7:
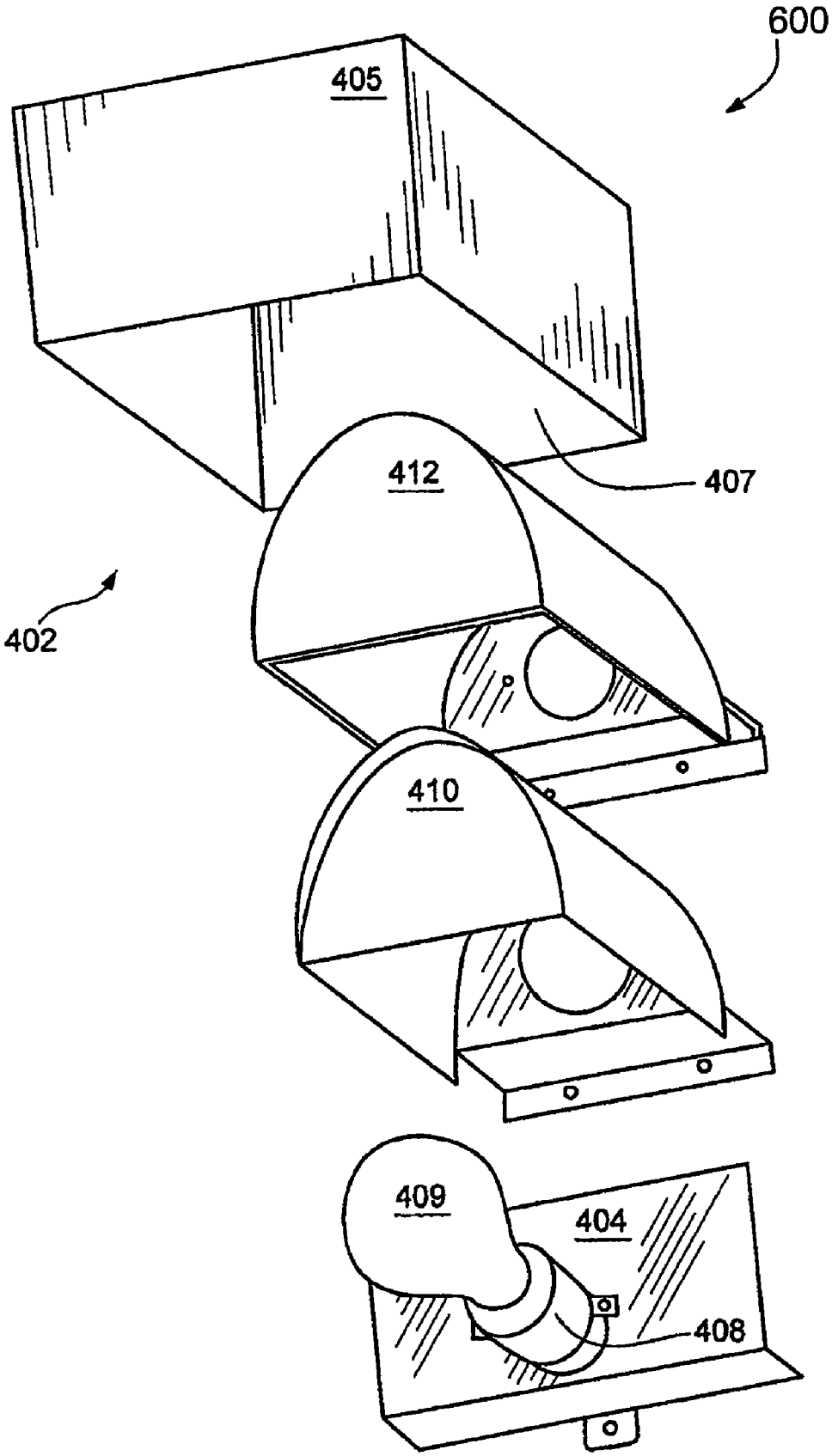
FIG. 7 is an exploded view of the lighting assembly in FIG. 6.

FIGS. 6 and 7 depict another embodiment of a light assembly 600 consistent with the present invention. The lighting assembly 600 includes a light fixture 402 and a trim 404 adapted to be installed on the light fixture 402. The trim 404 may include or be made from a fireproof material.

The lighting fixture 402 includes a fire box or housing 405, which may be made from steel or other fire resistant material. As shown, the housing 405 has a rectangular shape with an open bottom end 407 and a lamp socket 408 is adapted to be positioned relative to the open end 407 such that such a lamp 409 may be installed in the socket 408 through the open bottom end 407. The lighting assembly 600 includes a fire resistant reflector 410 and a heat resistant cover 412.

After installation of the light assembly 600 in a supporting structure (not shown in FIGS. 6 and 7) which may be a ceiling, a floor, or a wall of a room, the heat resistant cover 412 is adapted to enclose or envelop the reflector 410 so as to form a thermal insulating barrier that reduces heat from the lamp 409 installed into the lamp socket 408 and/or from a source below the supporting structure from reaching an area above the supporting structure and external to the light assembly 600.

Both the reflector 410 and heat resistant cover 412 are shown to have substantially half cylindrical shapes. However, the reflector 410 and heat resistant cover 412 may have any other shape or dimension.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A lighting assembly comprising:

a light fixture adapted to be disposed adjacent to an opening defined in a surface of a structure, wherein the light fixture is configured to accept a lamp installed through the opening;

a thermal insulation barrier surrounding the light fixture, positioned in close proximity of the opening of the structure and constructed so as to entrap heat received through the opening of the structure; and a trim having an outer surface configured to substantially enclose the opening, the trim comprising at least one fireproof material and being adapted to engage the light fixture so that the outer surface is disposed in proximity to the opening of the structure and forms a continuous surface with the structure.

2. A lighting assembly as in claim 1, wherein the thermal insulation baffler is integrally attached to the light fixture.

3. The lighting assembly as in claim 1, wherein the thermal insulation baffler is formed in the general shape of a cylinder.

4. The lighting assembly as in claim 1, wherein the thermal insulation baffler is generally formed in the shape of rectangle.

5. The lighting assembly as in claim 1, wherein the thermal insulation barrier comprises an insulating material suitable for continuous use at temperatures at or below about 1080 degrees F. with an "R-value" greater than 2.2 per inch of thickness, and being constructed in a manner to inhibit heat from transferring via an aperture of the light fixture through the lighting assembly to an area above the surface of the structure.

6. The lighting assembly as in claim 1, wherein the trim further comprises at least one component which substantially encloses an aperture of the light fixture and an outer portion of the trim which covers a gap between the light fixture and the structure.

7. The lighting assembly as in claim 1, wherein at least a portion of the trim is adapted to removeably engage the trim to the light fixture.

8. The lighting assembly as in claim 1, further comprising a housing having an internal surface and the thermal insulation baffler has at least one end disposed in proximity to the internal surface of the housing.

9. The lighting assembly as in claim 8, wherein the at least one end of the thermal insulation baffler follows a contour of the internal surface of the housing.

10. The lighting assembly as in claim 1, further comprising a housing having an external surface and the thermal insulation barrier has at least one end disposed in proximity to the external surface of the housing.

11. The lighting assembly as in claim 10, wherein the at least one end of the thermal insulation barrier follows a contour of the external surface of the housing.

12. The light assembly as in claim 1, wherein the trim further comprises thermal insulation disposed between the light fixture and the trim to inhibit heat from transferring via the trim through the lighting assembly to an area above the surface of the structure.

13. The light assembly as in claim 12, wherein the thermal insulation is adapted to cover at least a portion of the trim.

14. A thermal insulation barrier integral to a lighting fixture of a lighting assembly, the light fixture having an aperture and being adapted to be disposed adjacent to an opening defined in a surface of a structure, wherein the light fixture is configured to accept a lamp installed through the opening, the thermal insulation barrier forming a jacket around a housing of the light fixture and comprising an insulating material suitable for continuous use at temperatures at or below about 1080 degrees F. with an "R-value" greater than 2.2 per inch of thickness, and constructed in a manner to inhibit heat from transferring via the aperture of the light fixture through the lighting assembly to an area above the surface of the structure.

15. A trim for a lighting assembly, the trim adapted to mate with a light fixture of the light assembly, the light fixture being adapted to be disposed adjacent to an opening defined in a surface of a structure, wherein the light fixture is configured to accept a lamp installed through the opening, the trim comprising an outer surface, configured to substantially enclose the opening, comprising at least one fireproof material, and being adapted to engage the light fixture so that the outer surface is disposed in proximity to the opening of the structure and forms a continuous surface with the structure, the trim further comprising a gasket adapted to cover a portion of the trim so as to provide a seal between the trim and the surface of the structure while maintaining the continuous surface between the trim and the structure.

16. The trim as in claim 15, further comprising a thermal insulation baffler disposed between the light fixture and the trim to inhibit heat from transferring via the trim through the lighting assembly to an area above the surface of the structure.

17. The trim as in claim 16, wherein the thermal insulation barrier is adapted to cover at least a portion of the trim.

18. The trim as in claim 15, wherein the light fixture comprises a housing having an internal surface and the thermal insulation has at least one end disposed in proximity to the internal surface of the housing.

19. The trim as in claim 18, wherein the at least one end of the thermal insulation follows a contour of the internal surface of the housing.

* * * * *